United States Patent [19]

Guiboro

[11] 4,432,384

[45] Feb. 21, 1984

[54] SEWER FLUID TRAP

[76] Inventor: Marcel Guiboro, 124 Renaud St., Ile Perrot, Province of Quebec, Canada, J7V 5X5

[21] Appl. No.: 359,207

[22] Filed: Mar. 18, 1982

[51] Int. Cl.[3] ..... F16K 9/00

[52] U.S. Cl. ..... 137/247.11; 137/247.35; 137/247.39; 137/363

[58] Field of Search ..... 137/247.11, 247.35, 137/247.39, 248, 251, 363, 364

[56] References Cited

U.S. PATENT DOCUMENTS

| | | | |
|---|---|---|---|
| 197,255 | 11/1877 | Dark | 137/247.11 |
| 329,404 | 10/1885 | McConnell | 137/247.11 X |
| 343,335 | 6/1886 | O'Brien | 137/247.11 |
| 468,157 | 2/1892 | Shapley | 137/247.11 |

FOREIGN PATENT DOCUMENTS

| | | | |
|---|---|---|---|
| 693569 | 7/1953 | United Kingdom | 137/247.11 |

*Primary Examiner*—Harold W. Weakley

[57] ABSTRACT

A sewer fluid trap is disclosed, consisting of firstly a rigid flat plate permanently secured to a manhole wall surrounding a sewer pipe outlet. This flat plate has a pair of spaced-apart lateral slots. Secondly, an elbow having a lower end submerged in the catch-basin of a manhole and an upper end rigidly secured to a back-plate. The latter is removably inserted into the lateral slots, thereby forming a tight seal between itself and the back-plate. Central holes are formed in both plates and are in registry with the sewer pipe outlet when the trap is installed. A latch locks the two plates together. A ring is fixed to the elbow to lift the same and its back-plate from the manhole without having to descend into the same.

4 Claims, 5 Drawing Figures

SEWER FLUID TRAP

FIELD OF THE INVENTION

The present invention relates to sewer fluid-flow control devices, more specifically to an improved sewer fluid trap for a sewer which might contain undesirable sewer fluids, in order to prevent them from circulating in the sewer and/or discharging into the ambient atmosphere.

BACKGROUND OF THE INVENTION

In ordinary domestic sewer pipe systems and more often in industrial sewer networks, it frequently happens that noxious, toxic and even explosive gases and liquids are present and free to circulate through the sewer pipes. This poses a definite danger to cleaning and maintenance personnel. To cope with the problem, the prior art has developed various seals and traps to contain dangerous fluids in one location, so that they may be safely removed.

For example, Canadian Patent 918,531 teaches the use of a tank filled with water which acts as a seal to prevent the discharge of explosive sewer vapors into the surrounding air. However, this invention is designed for installation at the top of a manhole and would not prevent the circulation of such vapors in the sewer system underneath, which is where they form. Another Canadian Pat. No. 97,500, is similar to the present invention as disclosed below. Even so, this patent has the disadvantage of being relatively easily dislogable by a counter-flow of sewer fluids which sometimes occurs in a multiple manhole sewer network.

Other prior art generally teaches the use of devices which are more or less permanently installed. The fact that such devices are difficult to remove constitutes another disadvantage because they obstruct either a manhole or its catch-basin, or the sewer pipes themselves. Thus, modern maintenance equipment, such as closed-circuit t.v. cameras and cleaning machines adapted to be pulled through a sewer pipe by a cable, cannot be properly used.

OBJECTS OF THE INVENTION

In view of the above, it is a first object of the present invention to provide a sewer fluid trap which effectively contains undesirable sewer fluids and which is easily and entirely removable from a manhole for inspection, cleaning and maintenance purposes.

It is another important object of this invention to provide a sewer fluid trap which effectively prevents the circulation of undesirable sewer fluids through sewer pipes from one manhole to another.

It is yet another object of the present invention to provide a sewer fluid trap which is very simple in construction and non-costly to produce.

SUMMARY OF THE INVENTION

The above and other objects of the present invention are realized according to a preferred embodiment comprising, in combination, and firstly, a conventional sewer pipe opening into a manhole. The latter has a catch-basin in which solid or semi-solid waste materials may accumulate.

The invention proper consists of, secondly, a flat plate adapted to be rigidly and permanently secured to the side wall of the manhole surrounding the sewer pipe opening. The plate has a central hole which is in registry with the sewer pipe opening when it is installed in place.

The side edges of the flat plate are both formed with outwardly-extending and downwardly-tapering flanges. The latter are bent inwardly at their front edges such that they extend parallel to the flat plate itself, thus defining a pair of vertically-oriented lateral slots.

The invention further includes a downwardly-bent elbow having the same cross-section as that of the sewer pipe opening and the central hole of the flat plate. The lower end of the elbow is open, while the upper end is rigidly secured to a rigid and straight backplate.

The latter is generally rectangular in shape and has a width which is just slightly less than the distance between the inner surfaces of the two spaced-apart flanges of the flat plate.

A pair of spaced-apart ribs are integrally formed with the backplate and project frontwardly therefrom. They are also downwardly tapered. In this construction, there is thus a tight fit between the flat plate and the back-plate.

Latch means are provided for the latter two elements to ensure that they are not loosened from one another in the event of a powerful sewer fluid flow or counter-flow.

The elbow is provided with lift means whereby, once the latch means is operated, the elbow and its back-plate can be hoisted out of the manhole without a worker being obliged to descend into the manhole.

BRIEF DESCRIPTION OF THE DRAWINGS

The above will be more clearly understood by having referral to the preferred embodiment of the invention, illustrated by the accompanying drawings, in which.

Like numerals refer to like elements throughout the drawings.

DETAILED DESCRIPTION OF THE PREFERRED EMBODIMENT

Figure 1:
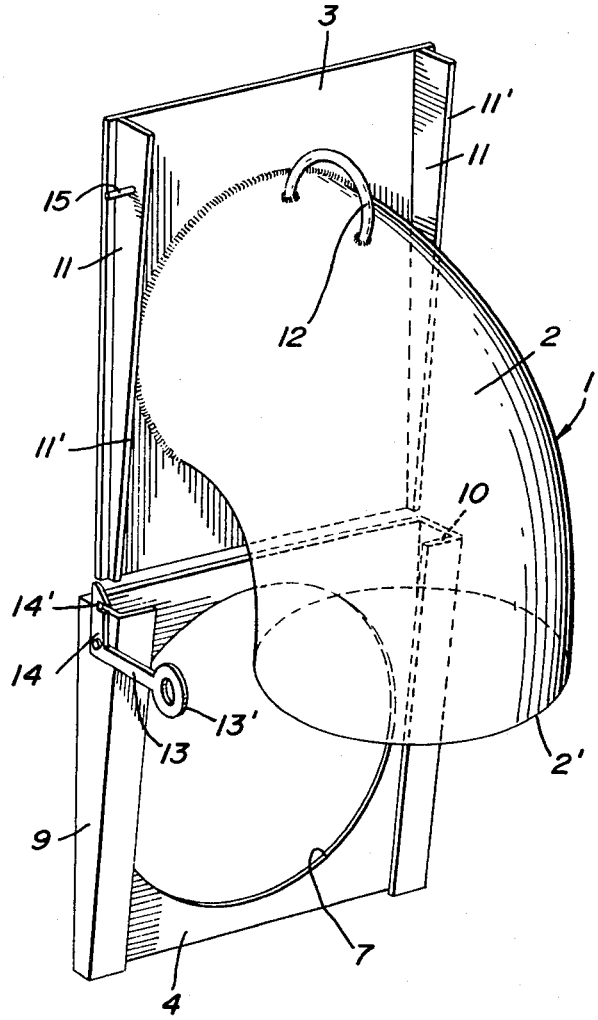
FIG. 1 is a perspective view of the trap, showing the flat plate and the back-plate in separated configuration.

Referring to FIG. 1, there is shown a preferred embodiment of the fluid trap 1. The latter consists of a downwardly-bent elbow 2 having a bottom opening 2'. The top end of elbow 2 is welded or otherwise rigidly secured to a back-plate 3. The latter is formed with a first central round hole communicating with elbow 2, and is generally square or rectangular.

The complementary element of the invention is also illustrated in FIG. 1, consisting of a flat rigid plate 4, which is designed to be bolted or otherwise rigidly and permanently secured to a manhole wall 5 surrounding a sewer pipe 6.

A second central round hole 7 is made in flat plate 4 and has the same cross-sectional area as sewer pipe 6 and the hole of backplate 3. It will be readily seen that both holes are in registry with themselves and the sewer pipe 6 when the device is installed in a manhole 8.

Plate 4 has a pair of lateral forwardly-extending flanges 9 which are downwardly tapered. The forward edge of both flanges 9 are bent inwardly and extend parallel to plate 4, defining vertically-oriented lateral slots 10.

Back-plate 3 is provided with a pair of laterally spaced-apart and downwardly-tapered ribs 11. These ribs 11 are secured slightly inwardly of the side edges of back-plate 3. The angle of taper of ribs 11 is the same as the angle of taper of flanges 9.

Once flat plate 4 is fastened to the manhole wall 5, it is a simple operation to lower back-plate 3 and its elbow 2 into position such that the side edges of back-plate 3 abut against the inner surfaces of flanges 9 and the front edges 11' of ribs 11 abut against the inner front surfaces of lateral slots 10. The fit between back-plate 3 and plate 4 is precise, therefore forming a seal to prevent any gases or liquids escaping from elbow 2.

To lift the elbow 2 out of a manhole 8, a ring 12 is provided on the top portion of elbow 2. This ring is adapted to be hooked to a rope or cable (not shown) lowered from the top of the manhole, thereby eliminating the need for a worker to descend into the manhole to perform a job.

To further ensure that the two plates 3 and 4 do not become loosened from one another if a surge of sewer fluid should occur, a latch means is provided to positively lock the two plates together. This latch means includes a forwardly-projecting arm 13 having an eye 13' and pivotally secured to the upper portion of one of the flanges 9. Arm 13 has a vertical latch portion 14 provided with a latch slot 14'.

The latter is adapted to lockingly receive a pin 15 which projects laterally from the upper portion of one of the ribs 11.

Thus, when back-plate 3 is slid downwardly into plate 4, the latch automatically engages pin 15 and effectively keeps the two plates 3 and 4 together. Yet to disengage the two plates involves only pulling on eye 13' with a rope or cable, and on ring 12 with another rope or cable and lift elbow 2.

Figures 2, 3, 4, 5:
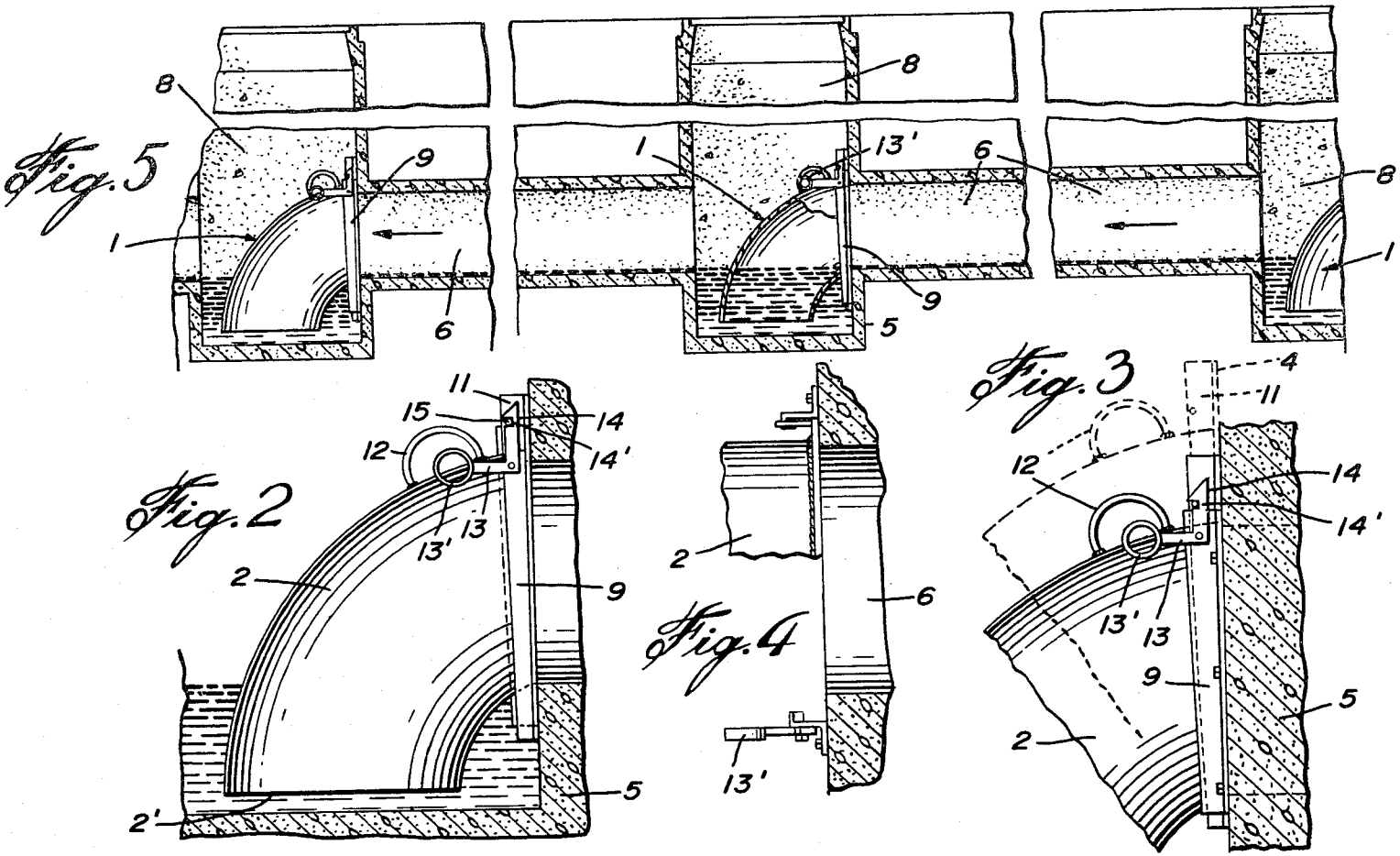
FIG. 2 is a side elevation of the trap installed in the catch-basin of a manhole.
FIG. 3 is a side elevation of the upper portion of the trap, showing in dashed outline how the elbow and the back-plate are lifted.
FIG. 4 is a top view, partially broken away, of the trap, the adjacent sewer pipe and the latch means.
FIG. 5 is a cross-sectioned side elevation, broken away, of a multiple manhole sewer system, also showing a trap according to the invention installed in each manhole.

Referring finally to FIG. 5, there is shown a multiple manhole sewer system, each manhole 8 having an elbow 2, with the arrows indicating the direction of sewer flow.

It will be clear that if gases or oils accumulate in any given sewer section, including a sewer pipe 6, elbow 2 and associated upstream manhole 8, or if a spill occurs therein, they will not flow in a downstream sewer section.

What I claim is:

1. A sewer fluid trap comprising, in combination, a manhole having a catch-basin and a sewer pipe opening into said manhole; a first plate having a fixed central hole adapted to be permanently installed on the manhole wall around said sewer pipe, such that said central hole is in registry with the latter; said flat plate being formed with a pair of lateral vertical slots; a back-plate adapted to overlie said first plate between said lateral slots; downwardly-depending elbow rigidly secured at its top end to said back-plate; the latter being provided with a second central hole in registry with said elbow; said elbow being open at its lower end, the latter being adapted to be submerged in said catch-basin; remotely-controlled latch means to positively lock said first plate and said back-plate together; and lift means to remove said elbow and said back-plate, whereby unlatching and lifting of said elbow and back-plate can be carried out without it being necessary to descend into said manhole.

2. A sewer fluid trap as claimed in claim 1, wherein said lateral slots are formmed by a pair of forwardly-extending flanges which are bent inwardly at their front edges.

3. A sewer fluid trap as claimed in claim 2, wherein said flanges are downwardly tapered and said back-plate is provided with a pair of laterally spaced-apart ribs, said ribs projecting forwardly and being tapered to the same angle as that of said flanges, whereby a gas-tight fit between said flat plate and said back-plate is obtained.

4. A sewer fluid trap as claimed in claim 3, wherein said latch means includes a forwardly-projecting arm pivotally secured to the top portion of one of said flanges and having an eye at its forward end; further having an upwardly-projecting latch portion provided with a latch slot; further including a laterally-projecting pin secured to one of said flanges and adapted to be engaged in said latch slot.

* * * * *